US012509818B2

(12) United States Patent
Honda et al.

(10) Patent No.: US 12,509,818 B2
(45) Date of Patent: Dec. 30, 2025

(54) SYNTHETIC FIBER PROCESSING AGENT, AND SYNTHETIC FIBER

(71) Applicant: TAKEMOTO YUSHI KABUSHIKI KAISHA, Aichi-ken (JP)

(72) Inventors: Hiroki Honda, Gamagori (JP); Takuya Matsunaga, Gamagori (JP); Keiichiro Oshima, Gamagori (JP)

(73) Assignee: TAKEMOTO YUSHI KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 18/028,138

(22) PCT Filed: Sep. 27, 2021

(86) PCT No.: PCT/JP2021/035330

§ 371 (c)(1),
(2) Date: Mar. 23, 2023

(87) PCT Pub. No.: WO2022/065476

PCT Pub. Date: Mar. 31, 2022

(65) Prior Publication Data

US 2023/0340721 A1 Oct. 26, 2023

(30) Foreign Application Priority Data

Sep. 28, 2020 (JP) ..... 2020-161861

(51) Int. Cl.
*D06M 13/207* (2006.01)
*D06M 15/643* (2006.01)
*D06M 101/28* (2006.01)

(52) U.S. Cl.
CPC ..... *D06M 13/207* (2013.01); *D06M 15/6436* (2013.01); *D06M 2101/28* (2013.01)

(58) Field of Classification Search
CPC ..... D06M 13/207; D06M 15/6436; D06M 2101/28
USPC ..... 8/115.6
See application file for complete search history.

(56) References Cited

U.S. PATENT DOCUMENTS

| | | | | |
|---|---|---|---|---|
| 5,840,943 | A | 11/1998 | Ansmann et al. | |
| 10,072,359 | B2 | 9/2018 | Aso et al. | |
| 2010/0285712 | A1 | 11/2010 | Somerville Roberts et al. | |
| 2019/0055384 | A1* | 2/2019 | Hamaguchi | C08L 57/00 |

FOREIGN PATENT DOCUMENTS

| | | | | | |
|---|---|---|---|---|---|
| CN | 108884281 | A | * | 11/2018 | |
| JP | H10-501252 | A | | 2/1998 | |
| JP | 2011-184842 | A | | 9/2011 | |
| JP | 2011241403 | | * | 12/2011 | |
| JP | 2012-526206 | A | | 10/2012 | |
| JP | 2013007141 | A | * | 1/2013 | |
| JP | 2016-044210 | A | | 4/2016 | |
| JP | 6523416 | | * | 5/2019 | |
| WO | WO2009122875 | | * | 10/2009 | C10M 141/02 |
| WO | WO 2015/186545 | A1 | | 12/2015 | |

OTHER PUBLICATIONS

International Search Report and Written Opinion dated Nov. 16, 2021, in connection with International Application No. PCT/JP2021/035330.
Japanese Decision to Grant dated Feb. 9, 2021, in connection with Japanese Application No. 2020-161861.
Extended European Search Report dated Oct. 5, 2023, in connection with European Application No. 21872603.2.

* cited by examiner

*Primary Examiner* — Amina S Khan
(74) *Attorney, Agent, or Firm* — Wolf, Greenfield & Sacks, P.C.

(57) ABSTRACT

Disclosed is a synthetic fiber treatment agent that contains a smoothing agent and a nonionic surfactant. The smoothing agent contains a condensed hydroxy fatty acid formed by condensation from a hydroxy fatty acid having a hydroxy group and a carboxy group in the molecule.

6 Claims, No Drawings

SYNTHETIC FIBER PROCESSING AGENT, AND SYNTHETIC FIBER

CROSS REFERENCE TO RELATED APPLICATIONS

This Application is a national stage filing under 35 U.S.C. 371 of International Patent Application Serial No PCT/JP2021/035330, filed Sep. 27, 2021, which claims priority to Japanese application number 2020-161861 filed, Sep. 28, 2020. The entire contents of these applications are incorporated herein by reference in their entirety.

TECHNICAL FIELD

The present invention relates to a synthetic fiber treatment agent and a synthetic fiber.

BACKGROUND ART

Carbon fibers are produced by, for example, performing a spinning step of spinning an acrylic resin or the like into fibers, a dry densification step of drying and densifying the spun fiber, a stretching step of stretching the dry-densified fiber to produce a carbon fiber precursor, which is a synthetic fiber, a flameproofing step of flameproofing the carbon fiber precursor, and a carbonization step of carbonizing the flameproofed fiber.

In a synthetic fiber production process, a synthetic fiber treatment agent may be used in order to improve the bundling property of fibers.

Patent Document 1 discloses an acrylic fiber oil agent for carbon fiber production that contains a modified silicone having a modified group with a nitrogen atom and a branched fatty acid. Patent Document 2 discloses a surface modifier that contains a fluorine-containing copolymer and a condensed hydroxy fatty acid.

CITATION LIST

Patent Literature

Patent Document 1: Japanese Laid-Open Patent Publication No. 2011-184842

Patent Document 2: Japanese Laid-Open Patent Publication No. 2016-44210

SUMMARY OF INVENTION

Technical Problem

The synthetic fiber treatment agent is required to further improve the performance, i.e., to have an effect of improving the bundling property in the synthetic fiber production process.

The present invention has been made in view of such circumstances, and an object of the present invention is to provide a synthetic fiber treatment agent that is capable of suitably improving the bundling property in a synthetic fiber production process. Another object of the present invention is to provide a synthetic fiber to which the synthetic fiber treatment agent is adhered.

Solution to Problem

A synthetic fiber treatment agent for solving the above problem contains a smoothing agent and a nonionic surfactant and is characterized in that the smoothing agent contains a condensed hydroxy fatty acid formed by condensation from a hydroxy fatty acid having a hydroxy group and a carboxy group in the molecule.

In the synthetic fiber treatment agent, the condensed hydroxy fatty acid is preferably formed by condensation from at least one selected from the group consisting of castor oil fatty acid, hydrogenated castor oil fatty acid, ricinoleic acid, and 12-hydroxystearic acid.

In the synthetic fiber treatment agent, the condensed hydroxy fatty acid preferably has a degree of condensation of 2 to 10.

In the synthetic fiber treatment agent, the smoothing agent preferably further contains an amino-modified silicone.

If the sum of the content ratios of the smoothing agent and the nonionic surfactant in the synthetic fiber treatment agent is taken as 100% by mass, the content ratio of the condensed hydroxy fatty acid in the synthetic fiber treatment agent is preferably 0.1% to 15% by mass.

The synthetic fiber treatment agent preferably further contains an ionic compound.

If the sum of the content ratios of the smoothing agent, the nonionic surfactant, and the ionic compound in the synthetic fiber treatment agent is taken as 100% by mass, the content ratio of the condensed hydroxy fatty acid in the synthetic fiber treatment agent is preferably 0.1% to 15% by mass.

In the synthetic fiber treatment agent, the synthetic fiber is preferably a carbon fiber precursor.

A synthetic fiber for solving the above problem is characterized in that the synthetic fiber treatment agent is adhered to the synthetic fiber.

Advantageous Effects of Invention

The present invention succeeds in suitably improving the bundling property of synthetic fibers.

DESCRIPTION OF EMBODIMENTS

First Embodiment

A first embodiment in which a synthetic fiber treatment agent (also simply referred to hereinafter as treatment agent) according to the present invention is embodied will be described.

The treatment agent of the present embodiment contains a smoothing agent and a nonionic surfactant. The smoothing agent contains a condensed hydroxy fatty acid formed by condensation from a hydroxy fatty acid having a hydroxy group and a carboxy group in the molecule.

The smoothing agent contains the condensed hydroxy fatty acid, and thus the bundling property of synthetic fibers can be suitably improved.

Specific examples of the condensed hydroxy fatty acid include a 12-hydroxystearic acid hexamer condensate, a castor oil fatty acid tetramer to pentamer condensate, a castor oil fatty acid hexamer condensate, a castor oil fatty acid dimer condensate, and a 12-hydroxydodecanoic acid pentamer condensate.

The condensed hydroxy fatty acid is not particularly limited, but is preferably formed by condensation from at least one selected from the group consisting of castor oil fatty acid, hydrogenated castor oil fatty acid, ricinoleic acid, and 12-hydroxystearic acid. The smoothing agent contains such a condensed hydroxy fatty acid, and thus wettability of the treatment agent to a synthetic fiber is improved, as will be described later.

The castor oil fatty acid and hydrogenated castor oil fatty acid mean fatty acids derived from castor oil and hydrogenated castor oil as raw materials.

The condensed hydroxy fatty acid preferably has a degree of condensation of 2 to 10.

As the condensed hydroxy fatty acid, one condensed hydroxy fatty acid may be used alone, or two or more condensed hydroxy fatty acids may be used in combination.

The condensed hydroxy fatty acid may be a commercially available product or may be produced by a known method. When the condensed hydroxy fatty acid is produced by a known method, it can be produced by, for example, a dehydration condensation reaction between a hydroxy group and a carboxyl group contained in a raw material substance.

The condensed hydroxy fatty acid may form a salt with a basic component such as another amine or metal in the treatment agent.

The treatment agent of the present embodiment preferably contains a smoothing agent other than the condensed hydroxy fatty acid. Examples of the smoothing agent other than the condensed hydroxy fatty acid include a silicone and an ester.

The silicone used as the smoothing agent is not particularly limited, and examples thereof include dimethyl silicone, phenyl-modified silicone, amino-modified silicone, amide-modified silicone, polyether-modified silicone, aminopolyether-modified silicone, alkyl-modified silicone, alkylaralkyl-modified silicone, alkylpolyether-modified silicone, ester-modified silicone, epoxy-modified silicone, carbinol-modified silicone, and mercapto-modified silicone.

Specific examples of the ester used as the smoothing agent include (1) ester compounds of an aliphatic monoalcohol and an aliphatic monocarboxylic acid, such as octyl palmitate, oleyl laurate, oleyl oleate, and isotetracosyl oleate, (2) ester compounds of an aliphatic polyhydric alcohol and an aliphatic monocarboxylic acid, such as 1,6-hexanediol didecanate, glycerin trioleate, trimethylolpropane trilaurate, and pentaerythritol tetraoctanate, (3) ester compounds of an aliphatic monoalcohol and an aliphatic polycarboxylic acid, such as dioleyl azelate, dioleyl thiodipropionate, diisocetyl thiodipropionate, and diisostearyl thiodipropionate, (4) ester compounds of an aromatic monoalcohol and an aliphatic monocarboxylic acid, such as benzyl oleate and benzyl laurate, (5) complete ester compounds of an aromatic polyhydric alcohol and an aliphatic monocarboxylic acid, such as bisphenol A dilaurate and bisphenol A, (6) complete ester compounds of an aliphatic monoalcohol and an aromatic polycarboxylic acid, such as bis2-ethylhexyl phthalate, diisostearyl isophthalate, and trioctyl trimellitate, and (7) natural fats and oils, such as coconut oil, rapeseed oil, sunflower oil, soybean oil, castor oil, sesame oil, fish oil, and beef tallow. A known smoothing agent or the like used in a synthetic fiber treatment agent may be used.

Specific examples of the smoothing agent other than the condensed hydroxy fatty acid include an amino-modified silicone having a kinematic viscosity at 25° C. of 650 $mm^2/s$ and an amino equivalent of 1,800 g/mol, an amino-modified silicone having a kinematic viscosity at 25° C. of 90 $mm^2/s$ and an amino equivalent of 5,000 g/mol, an amino-modified silicone having a kinematic viscosity at 25° C. of 4,500 $mm^2/s$ and an amino equivalent of 1,200 g/mol, a polyether-modified silicone having a kinematic viscosity at 25° C. of 1,700 $mm^2/s$, silicone main chain/polyether side chain=20/80 (mass ratio), and ethylene oxide/propylene oxide=50/50 (molar ratio), and a dilauryl ester of an ethylene oxide 2-mol adduct of bisphenol A.

The smoothing agent preferably contains a modified silicone, and more preferably contains an amino-modified silicone.

As the smoothing agent, one smoothing agent may be used alone, or two or more smoothing agents may be used in combination.

The nonionic surfactant contained in the treatment agent of the present embodiment is not particularly limited, and examples thereof include those obtained by adding an alkylene oxide to an alcohol or a carboxylic acid, an ester compound of a carboxylic acid and a polyhydric alcohol, and an ether ester compound obtained by adding an alkylene oxide to an ester compound of a carboxylic acid and a polyhydric alcohol.

Specific examples of the alcohol used as the raw material for the nonionic surfactant include (1) linear alkyl alcohols, such as methanol, ethanol, propanol, butanol, pentanol, hexanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, pentacosanol, hexacosanol, heptacosanol, octacosanol, nonacosanol, and tricontanol, (2) branched alkyl alcohols, such as isopropanol, isobutanol, isohexanol, 2-ethylhexanol, isononanol, isodecanol, isododecanol, isotricanol, isotetradecanol, isotriacontanol, isohexadecanol, isoheptadecanol, isooctadecanol, isononadecanol, isoeicosanol, isoheneicosanol, isodocosanol, isotricosanol, isotetracosanol, isopentacosanol, isohexacosanol, isoheptacosanol, isooctacosanol, isononacosanol, and isopentadecanol, (3) linear alkenyl alcohols, such as tetradecenol, hexadecenol, heptadecenol, octadecenol, and nonadecenol; (4) branched alkenyl alcohols, such as isohexadecenol and isooctadecenol, (5) cyclic alkyl alcohols, such as cyclopentanol and cyclohexanol, and (6) aromatic alcohols, such as phenol, nonylphenol, benzyl alcohol, monostyrenated phenol, distyrenated phenol, and tristyrenated phenol.

Specific examples of the carboxylic acid used as a raw material for the nonionic surfactant include (1) linear alkyl carboxylic acids, such as octylic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, and docosanoic acid, (2) branched alkyl carboxylic acids, such as 2-ethylhexanoic acid, isododecanoic acid, isotridecanoic acid, isotetradecanoic acid, isohexadecanoic acid, and isooctadecanoic acid, (3) linear alkenyl carboxylic acids, such as octadecenoic acid, octadecadienoic acid, and octadecatrienoic acid, and (4) aromatic carboxylic acids, such as benzoic acid.

Specific examples of the alkylene oxide used as a raw material for the nonionic surfactant include ethylene oxide and propylene oxide. The number of moles of the alkylene oxide added is appropriately set, and is preferably 0.1 to 60 mol, more preferably 1 to 40 mol, and still more preferably 2 to 30 mol. The number of moles of the alkylene oxide added represents the number of moles of the alkylene oxide per mole of an alcohol or a carboxylic acid in charged raw materials.

Specific examples of the polyhydric alcohol used as a raw material for the nonionic surfactant include ethylene glycol, propylene glycol, 1,3-propanediol, 1,2-butanediol, 1,3-butanediol, 1,4-butanediol, 1,4-butanediol, 2-methyl-1,2-propanediol, 1,5-pentanediol, 1,6-hexanediol, 2,5-hexanediol, 2-methyl-2,4-pentanediol, 2,3-dimethyl-2,3-butanediol, glycerin, 2-methyl-2-hydroxymethyl-1,3-propanediol, 2-ethyl-2-hydroxymethyl-1,3-propanediol, trimethylolpropane, sorbitan, pentaerythritol, and sorbitol.

Specific examples of the nonionic surfactant include an ethylene oxide 10-mol adduct of dodecyl alcohol and an ethylene oxide 8-mol adduct of tetradecyl alcohol.

As the nonionic surfactant, one nonionic surfactant may be used alone, or two or more nonionic surfactants may be used in combination.

The content of the smoothing agent, which contains the condensed hydroxy fatty acid, and the content of the nonionic surfactant are not limited. If the sum of the content ratios of the smoothing agent and the nonionic surfactant is taken as 100% by mass, the content ratio of the condensed hydroxy fatty acid is preferably 0.1% to 15% by mass, and more preferably 0.3% to 13% by mass.

The treatment agent of the present embodiment preferably further contains an ionic compound. The treatment agent contains the ionic compound, and thus the bundling property of synthetic fibers can be further improved.

The ionic compound means a compound having an ion binding property. Examples of the compound having an ion binding property include sulfonate salts, sulfate salts, phosphate salts, fatty acid salts, ammonium salts, phosphonium salts, and imidazoline compounds.

As the ionic compound, one ionic compound may be used alone, or two or more ionic compounds may be used in combination.

The contents of the smoothing agent, the nonionic surfactant, and the ionic compound are not limited. If the sum of the content ratios of the smoothing agent, the nonionic surfactant, and the ionic compound in the treatment agent is taken as 100% by mass, the content ratio of the condensed hydroxy fatty acid is preferably 0.1% to 15% by mass, and more preferably 0.3% to 13% by mass.

Second Embodiment

A second embodiment in which a synthetic fiber according to the present invention is embodied will be described. The treatment agent of the first embodiment is adhered to a synthetic fiber of the present embodiment. Specific examples of the synthetic fiber are not particularly limited, and include (1) polyester fibers, such as polyethylene terephthalate, polypropylene terephthalate, and polylactic acid ester, (2) polyamide fibers, such as nylon 6 and nylon 66, (3) polyacrylic fibers, such as polyacrylic and modacrylic fibers, (4) polyolefinic fibers, such as polyethylene and polypropylene, (5) cellulose fibers, and (6) lignin fibers.

The synthetic fiber is preferably a hydrophobic synthetic fiber. When the synthetic fiber is a hydrophobic synthetic fiber, the treatment agent can suitably modify the fiber surface to impart hydrophilicity when adhered thereto. Examples of the hydrophobic synthetic fiber include the synthetic fibers (1) to (4) and (6) described above.

The synthetic fiber is preferably a resin-made carbon fiber precursor that becomes a carbon fiber through a carbonization step, which will be described later. A resin forming the carbon fiber precursor is not particularly limited, and examples thereof include an acrylic resin, a polyethylene resin, a phenol resin, a cellulose resin, a lignin resin, and pitch.

The amount of the treatment agent of the first embodiment to be adhered to the synthetic fiber is not particularly limited. However, it is preferable that the treatment agent (not containing a solvent) is adhered to the synthetic fiber in an amount of 0.1% to 2% by mass, and it is more preferable that the treatment agent is adhered to the synthetic fiber in an amount of 0.3% to 1.2% by mass.

Examples of the form of the treatment agent of the first embodiment when adhered to the fiber include an organic solvent solution and an aqueous solution.

As the method of adhering the treatment agent to the synthetic fiber, for example, a method of adhering the treatment agent to the synthetic fiber by a known method, for example, an immersion method, a spray method, a roller method, a guide lubrication method using a metering pump, or the like using the treatment agent of the first embodiment and an aqueous solution containing water or a further diluted aqueous solution can be used.

A method for producing a carbon fiber using the treatment agent according to the present invention and the synthetic fiber to which the treatment agent is adhered will be described.

The method for producing carbon fiber preferably includes the following steps 1 to 3.

Step 1: a spinning step of spinning the synthetic fiber and adhering the treatment agent of the first embodiment thereto.

Step 2: a flameproofing step of converting the synthetic fiber obtained in the above step 1 into a flameproofed fiber in an oxidizing atmosphere at 200° C. to 300° C., preferably 230° C. to 270° C.

Step 3: a carbonization step of carbonizing the flameproofed fiber obtained in the above step 2 in an inert atmosphere at 300° C. to 2,000° C., preferably 300° C. to 1,300° C.

The spinning step preferably includes a wet spinning step of dissolving a resin in a solvent to spin the synthetic fiber, a dry densification step of drying and densifying the wet-spun synthetic fiber, and a stretching step of stretching the dry-densified synthetic fiber.

A temperature in the dry densification step is not particularly limited, but it is preferable to heat the synthetic fiber subjected to the wet spinning step at, for example, 70° C. to 200° C. A timing of adhering the treatment agent to the synthetic fiber is not particularly limited, but is preferably between the wet spinning step and the dry densification step.

The oxidizing atmosphere in the flameproofing step is not particularly limited, and, for example, an air atmosphere can be used.

The inert atmosphere in the carbonization step is not particularly limited, and, for example, a nitrogen atmosphere, an argon atmosphere, or a vacuum atmosphere can be used.

The treatment agent and synthetic fiber of the embodiments can provide the following effects.

(1) The treatment agent of the present embodiment contains a smoothing agent and a nonionic surfactant. The smoothing agent contains a condensed hydroxy fatty acid formed by condensation from a hydroxy fatty acid having a hydroxy group and a carboxy group in the molecule. Thus, the bundling property of synthetic fibers can be suitably improved.

(2) The treatment agent of the present embodiment has improved wettability to a synthetic fiber. Therefore, the treatment agent can be more uniformly adhered to the synthetic fiber.

(3) The treatment agent is adhered to the synthetic fiber at a timing between the wet spinning step and the dry densification step. Therefore, the bundling property of synthetic fibers subjected to the spinning step, particularly the dry densification step, can be improved.

The above embodiment can be modified and implemented as follows. The above-described embodiments and the following modifications can be implemented in combination with each other, as long as there is no technical contradiction.

In the present embodiment, the treatment agent is adhered to a synthetic fiber at a timing between the wet spinning step and the dry densification step, but the present invention is not limited to this aspect. The treatment agent may be adhered to a synthetic fiber at a timing between the dry densification step and the stretching step, or the treatment agent may be adhered to a synthetic fiber at a timing between the stretching step and the flameproofing step.

In the present embodiment, the synthetic fiber treatment agent contains a smoothing agent other than the condensed hydroxy fatty acid, but the present invention is not limited to this aspect. The smoothing agent other than the condensed hydroxy fatty acid may not be used.

In the present embodiment, for example, the synthetic fiber may be a fiber that is subjected to the flameproofing step but is not subjected to the carbonization step. The fiber may be a fiber that is subjected to neither the flameproofing step nor the carbonization step.

The treatment agent or aqueous solution of the present embodiment may further contain a component usually used in a treatment agent or aqueous solution, such as a stabilizer, an antistatic agent, an antistat, a binder, an antioxidant, or an ultraviolet absorber for maintaining the quality of the treatment agent or aqueous solution, as long as the effects of the present invention are not impaired.

EXAMPLES

Examples will now be given below to describe the features and effects of the present invention more specifically, but the present invention is not limited to these examples. In the following description of working examples and comparative examples, "%" means % by mass.

Experimental Part 1 (Preparation of Synthetic Fiber Treatment Agent)

Example 1

The components shown in Table 1 were added to a beaker so that the condensed hydroxy fatty acid (A-1) was blended in a proportion of 5%, that the smoothing agent (B-1) other than the condensed hydroxy fatty acid was blended in a proportion of 78%, that the nonionic surfactant (C-1) was blended in a proportion of 15%, and that the ionic compound (D-1) was blended in a proportion of 2%. These components were stirred and mixed well. While stirring was continued, ion-exchanged water was gradually added so that the solid content reached 25%, thereby preparing a 25% aqueous solution of a synthetic fiber treatment agent of Example 1.

Examples 2 to 20 and Comparative Examples 1 to 4

Synthetic fiber treatment agents of Examples 2 to 20 and Comparative Examples 1 to 4 were prepared by the same method as in Example 1, using the components shown in Table 1.

The type and content of the condensed hydroxy fatty acid, the type and content of the smoothing agent other than the condensed hydroxy fatty acid, the type and content of the nonionic surfactant, and the type and content of the ionic compound in each of the treatment agents of the examples are as shown in the "condensed hydroxy fatty acid" column, the "smoothing agent other than condensed hydroxy fatty acid" column, the "nonionic surfactant" column, and the "ionic compound" column in Table 1, respectively.

TABLE 1

| | Smoothing agent | | | | | | | | Evaluation | |
|---|---|---|---|---|---|---|---|---|---|---|
| | Condensed hydroxy fatty acid | | Smoothing agent other than condensed hydroxy fatty acid | | Nonionic surfactant | | Ionic compound | | | |
| | Symbol | Ratio (% by mass) | Symbol | Ratio (% by mass) | Symbol | Ratio (% by mass) | Symbol | Ratio (% by mass) | Spin bundling property | Wettability |
| Example 1 | A-1 | 5 | B-1 | 78 | C-1 | 15 | D-1 | 2 | ○○ | ○○ |
| Example 2 | A-2 | 5 | B-1 | 78 | C-1 | 15 | D-1 | 2 | ○○ | ○○ |
| Example 3 | A-3 | 5 | B-1 | 78 | C-1 | 15 | D-1 | 2 | ○○ | ○○ |
| Example 4 | A-4 | 5 | B-1 | 78 | C-1 | 15 | D-1 | 2 | ○○ | ○○ |
| Example 5 | A-1 | 5 | B-1 | 78 | C-1 | 15 | D-2 | 2 | ○○ | ○○ |
| Example 6 | A-1 | 5 | B-1 | 78 | C-1 | 15 | D-3 | 2 | ○○ | ○○ |
| Example 7 | A-1 | 5 | B-1 | 79.9 | C-1 | 15 | D-1 | 0.1 | ○○ | ○○ |
| Example 8 | A-1 | 5 | B-1 | 72 | C-1 | 15 | D-1 | 8 | ○○ | ○○ |
| Example 9 | A-1 | 13 | B-1 | 68 | C-1 | 17 | D-1 | 2 | ○○ | ○○ |
| Example 10 | A-2 | 3 | B-1 | 64 | C-2 | 31 | D-1 | 2 | ○○ | ○○ |
| Example 11 | A-1 | 0.3 | B-1 | 78 | C-1 | 19.7 | D-1 | 2 | ○○ | ○○ |
| Example 12 | A-1 | 2 | B-1 | 75 | C-1 | 20 | D-1 | 3 | ○○ | ○○ |
| Example 13 | A-1 | 4 | B-2 | 77 | C-1 | 17 | D-1 | 2 | ○○ | ○○ |
| Example 14 | A-1 | 9 | B-3 | 73 | C-1 | 16 | D-1 | 2 | ○○ | ○○ |
| Example 15 | A-1 | 10 | B-1 | 55 | C-1 | 30 | D-1 | 5 | ○○ | ○○ |
| Example 16 | A-1 | 5 | B-1 | 75 | C-1 | 20 | — | — | ○ | ○○ |
| Example 17 | A-5 | 5 | B-1 | 70 | C-1 | 20 | D-1 | 5 | ○○ | ○ |
| Example 18 | A-1 | 5 | B-5 | 73 | C-1 | 20 | D-1 | 2 | ○○ | ○ |
| Example 19 | A-1 | 5 | B-4 | 75 | C-1 | 20 | — | — | ○ | ○ |
| Example 20 | A-1 | 5 | B-5 | 75 | C-1 | 20 | — | — | ○ | ○ |
| Comparative Example 1 | ra-1 | 5 | B-1 | 78 | C-1 | 15 | D-1 | 2 | x | x |

TABLE 1-continued

| | Smoothing agent | | | | | | | | Evaluation | |
|---|---|---|---|---|---|---|---|---|---|---|
| | Condensed hydroxy fatty acid | | Smoothing agent other than condensed hydroxy fatty acid | | Nonionic surfactant | | Ionic compound | | Spin | |
| | Symbol | Ratio (% by mass) | Symbol | Ratio (% by mass) | Symbol | Ratio (% by mass) | Symbol | Ratio (% by mass) | bundling property | Wettability |
| Comparative Example 2 | ra-2 | 5 | B-1 | 80 | C-2 | 15 | — | — | x | x |
| Comparative Example 3 | ra-3 | 5 | B-1 | 70 | C-1 | 25 | — | — | x | x |
| Comparative Example 4 | — | — | B-1 | 80 | C-1 | 20 | — | — | x | x |

Details of the respective components A-1 to A-5, ra-1 to ra-3, B-1 to B-5, C-1, C-2, and D-1 to D-3 indicated in the symbol columns of Table 1 are as follows.

(Condensed hydroxy fatty acid)

A-1: 12-hydroxystearic acid hexamer condensate

A-2: castor oil fatty acid tetramer to pentamer condensate

A-3: castor oil fatty acid hexamer condensate

A-4: castor oil fatty acid dimer condensate

A-5: 12-hydroxydodecanoic acid pentamer condensate ra-1: 12-hydroxystearic acid ra-2: castor oil fatty acid ra-3: isostearic acid (Smoothing Agent Other than Condensed Hydroxy Fatty Acid)

B-1: amino-modified silicone having a kinematic viscosity at 25° C. of 650 $mm^2/s$ and an amino equivalent of 1,800 g/mol B-2: amino-modified silicone having a kinematic viscosity at 25° C. of 90 $mm^2/s$ and an amino equivalent of 5,000 g/mol B-3: amino-modified silicone having a kinematic viscosity at 25° C. of 4,500 $mm^2/s$ and an amino equivalent of 1,200 g/mol B-4: polyether-modified silicone having a kinematic viscosity at 25° C. of 1,700 $mm^2/s$, silicone main chain/polyether side chain=20/80 (mass ratio), and ethylene oxide/propylene oxide=50/50 (molar ratio)

B-5: dilauryl ester of ethylene oxide 2-mol adduct of bisphenol A (Nonionic Surfactant)

C-1: ethylene oxide 10-mol adduct of dodecyl alcohol

C-2: ethylene oxide 8-mol adduct of tetradecyl alcohol (Ionic Compound)

D-1: ethyl sulfate salt of 1-ethyl-2-(heptadecenyl)-4,5-dihydro-3-(2-hydroxyethyl)-1H-imidazolinium D-2: sodium salt of dioctyl sulfosuccinic acid D-3: tetrabutylphosphonium salt of dodecylbenzenesulfonic acid

Experimental Part 2 (Production of Synthetic Fiber and Carbon Fiber)

Synthetic fibers and carbon fibers were produced using the synthetic fiber treatment agent prepared in Experimental Part 1.

First, as step 1, an acrylic resin was wet-spun. Specifically, a copolymer composed of 95% by mass of acrylonitrile, 3.5% by mass of methyl acrylate, and 1.5% by mass of methacrylic acid and having a limiting viscosity of 1.80 was dissolved in dimethylacetamide (DMAC) to prepare a spinning dope having a polymer concentration of 21.0% by mass and a viscosity at 60° C. of 500 poise. The spinning dope was discharged from a spinneret having a hole diameter (inner diameter) of 0.075 mm and the number of holes of 12,000, at a draft ratio of 0.8, into a coagulation bath of a 70% by mass aqueous solution of DMAC kept at a spinning bath temperature of 35° C.

The coagulated yarn was stretched 5 times in a water washing tank simultaneously with solvent removal to prepare a water-swollen acrylic fiber strand (raw material fiber). The synthetic fiber treatment agent prepared in Experimental Part 1 was fed to the acrylic fiber strand so that the amount of solid contents adhered was 1% by mass (containing no solvent). The synthetic fiber treatment agent was fed by an immersion method using a 4% ion-exchanged aqueous solution of the synthetic fiber treatment agent. Thereafter, the acrylic fiber strand was subjected to a dry densification treatment with heating rollers at 130° C., further stretched 1.7 times between heating rollers at 170° C., and then wound into a yarn tube using a winding device.

Next, as step 2, a yarn was unwound from the wound synthetic fiber, subjected to a flameproofing treatment in an air atmosphere for 1 hour in a flameproofing furnace having a temperature gradient of 230° C. to 270° C., and then wound into a yarn tube to obtain a flameproofed yarn (flameproofed fiber).

Next, as step 3, a yarn was unwound from the wound flameproofed yarn, fired in a carbonization furnace having a temperature gradient of 300° C. to 1,300° C. under a nitrogen atmosphere to convert the yarn into a carbon fiber, and then wound into a yarn tube to obtain a carbon fiber.

Experimental Part 3 (Evaluation)

For the treatment agents of Examples 1 to 20 and Comparative Examples 1 to 4, the bundling property of synthetic fibers and the wettability were evaluated. The procedures for each test will be shown below.

(Spin Bundling Property)

In step 1 of Experimental Part 2, the bundling state when the acrylic fiber strand fed with the synthetic fiber treatment agent passed through the heating rollers was visually observed, and the bundling property was evaluated according to the following criteria. The results are shown in the "spin bundling property" column in Table 1.

Evaluation Criteria for Bundling Property of Synthetic Fiber

○○ (good): The synthetic fibers are good in bundling property, are not wound around the heating rollers, and have no problem in operability.

○ (fair): The yarns are slightly loosened in some cases, but are not broken, and have no problem in operability.

x (poor): The yarns are often loosened and frequently broken, affecting operability.

(Wettability)

A 4% ion-exchanged aqueous solution of active ingredients of the synthetic fiber treatment agent (components other than the ion-exchanged water as the active ingredients) was prepared, 0.1 g of the solution was added dropwise onto an acrylic plate, and the maximum diameter (mm) after 1 minute was measured and evaluated according to the following criteria. The results are shown in the "wettability" column in Table 1.

Evaluation Criteria for Wettability

○○ (good): The maximum diameter is 12 mm or more.

○ (fair): The maximum diameter is 10 mm or more and less than 12 mm.

x (poor): The maximum diameter is less than 10 mm.

From the results shown in Table 1, the present invention succeeds in suitably improving the bundling property of synthetic fibers. In addition, the synthetic fiber treatment agent of the present invention has improved wettability to a synthetic fiber.

The invention claimed is:

1. A synthetic fiber treatment agent comprising a smoothing agent and a nonionic surfactant, wherein the smoothing agent contains a condensed hydroxy fatty acid formed by condensation only from a hydroxy fatty acid having a hydroxy group and a carboxy group in the molecule, the smoothing agent further contains a modified silicone that is amino-modified silicone, taking the sum of the content ratios of the smoothing agent and the nonionic surfactant in the synthetic fiber treatment agent as 100% by mass, the content ratio of the condensed hydroxy fatty acid in the synthetic fiber treatment agent is 0.1% to 15% by mass, and the condensed hydroxy fatty acid is a castor oil fatty acid condensate or a hydrogenated castor oil fatty acid condensate.

2. The synthetic fiber treatment agent according to claim 1, wherein the condensed hydroxy fatty acid has a degree of condensation of 2 to 10.

3. The synthetic fiber treatment agent according to claim 1, further comprising an ionic compound.

4. The synthetic fiber treatment agent according to claim 3, wherein taking the sum of the content ratios of the smoothing agent, the nonionic surfactant, and the ionic compound in the synthetic fiber treatment agent as 100% by mass, the content ratio of the condensed hydroxy fatty acid in the synthetic fiber treatment agent is 0.1% to 15% by mass.

5. The synthetic fiber treatment agent according to claim 1, wherein the synthetic fiber is a carbon fiber precursor.

6. A synthetic fiber to which the synthetic fiber treatment agent according to claim 1 is adhered.

* * * * *